United States Patent [19]

Catallo

[11] 3,973,305

[45] Aug. 10, 1976

[54] APPARATUS FOR CONDITIONING AND CALENDERING CIRCULAR KNIT TUBULAR FABRICS

[76] Inventor: Frank Catallo, 84 Wheatley Road, Old Westbury, N.Y. 11568

[22] Filed: Feb. 3, 1975

[21] Appl. No.: 546,506

[52] U.S. Cl. ..... 26/81; 26/51.3; 26/85

[51] Int. Cl.[2] ..... D06C 5/00

[58] Field of Search ..... 26/51.3, 55 R, 56, 81, 26/84, 85

[56] References Cited

UNITED STATES PATENTS

| | | | |
|---|---|---|---|
| 118,519 | 8/1971 | Denton | 26/55 R |
| 448,817 | 3/1891 | Harder | 26/56 |
| 1,326,057 | 12/1919 | Huber | 26/51.3 |
| 1,387,155 | 8/1921 | Huber | 26/51.3 |
| 2,109,469 | 3/1938 | Cohn et al. | 26/56 |
| 2,503,705 | 4/1950 | Blumenbaum et al. | 26/51.3 UX |
| 2,583,630 | 1/1952 | Chatfield | 26/55 R X |
| 2,589,344 | 3/1952 | Cohn et al. | 26/55 R X |
| 3,126,606 | 3/1964 | Beard | 26/55 R |
| 3,332,124 | 7/1967 | Beard | 26/55 R X |
| 3,436,796 | 4/1969 | Coates | 26/51.3 X |
| 3,479,706 | 11/1969 | Catallo | 26/55 R |
| 3,543,409 | 12/1970 | Fuhs et al. | 26/56 X |
| 3,678,545 | 7/1972 | Hino et al. | 26/56 |
| 3,762,003 | 10/1973 | Frezza | 26/56 |
| 3,875,624 | 4/1975 | Frezza | 26/56 |
| 3,883,935 | 5/1975 | Catallo et al. | 26/55 R |

*Primary Examiner*—Robert R. Mackey
*Attorney, Agent, or Firm*—Thomas E. Tate

[57] ABSTRACT

The disclosure is that of conditioning equipment for performing either straightening or overfeed calendering operations upon circular knit fabric tubes and includes a feed stand, a control roll station, a drive roll station, a steaming station and a calender station. A horizontal spreader extends from the control roll station to the calender station and provides a circumferential drive for the fabric tube at the control roll station, a face drive therefor at the drive roll station and an internal edge drive therefor along at least that portion of the length of the spreader that extends from the control roll station through the drive roll station. Thermo-fixing of the conditioned fabric tube also may be effected.

10 Claims, 11 Drawing Figures

APPARATUS FOR CONDITIONING AND CALENDERING CIRCULAR KNIT TUBULAR FABRICS

THE INVENTION

This invention relates generally to new and useful improvements in those types of fabric conditioning equipment frequently referred to as calenders and particularly seeks to provide a novel fabric conditioner that can be used as both a straightening calender for finishing or conditioning transversely striped or patterned circular knit fabric tubes and as an overfeed calender for finishing or conditioning plain circular knit fabric tubes.

In both types of calender finishing of circular knit tubular fabrics the equipment must be provided with a proper conveyor and feeding system, including a spreader and steaming arrangement and a pair of calender rolls, in order to establish size, weight, straightness, and, to some degree, hand, of the fabric tubes being operated upon.

In the calender finishing of transversely striped or patterned circular knit tubular fabrics, the operations are effected throughout under controlled tensions, while in the calender finishing of plain circular knit tubular fabrics of the types such as those used for underwear garments, the operations are effected under conditions of little or no tension and an overfeed takes place at the steaming station to help reduce length shrinkage. In both types of finishing, the cloth condition in the steaming area determines the result and the calender rolls may or may not be used to effect a pressed finish.

Heretofore, separate finishing calenders have been required for each of the straightening and overfeed types of operations because a calender properly designed for straightening operations on striped fabrics could not be used for overfeed operations on plain fabrics and vice versa.

However, a fabric conditioner constructed in accordance with this invention solves that problem and provides a single conditioning unit that selectively can be used for either straightening or overfeed types of finishing operations on circular tubular knit fabrics.

Further, the fabric conditioner of this invention also provides means for thermo-fixing the polyester or other synthetic yarns in knit tubes of such yarns or blends of synthetic and natural fiber yarns, since it has been determined that the general dimensional and geometric stability of the knit tubes is enhanced thereby.

Therefore, an object of this invention is to provide a novel fabric conditioner that can be used for both straightening and overfeeding types of calender finishing operations on circular tubular knit fabrics.

Another object of this invention is to provide a fabric conditioner of the character stated that includes a cloth entry system, a spreader cooperatively associated with feed and control rolls, a steaming station, a calender station and a delivery system such as a take-away conveyor or a folder.

Another object of this invention is to provide a fabric conditioner of the character stated that also includes radiant heat means for thermo-fixing any synthetic yarns that may be present in the fabric tube, after the fabric tube has been subjected to a calender finishing operation.

Another object of this invention is to provide a fabric conditioner of the character stated in which the cloth entry system is adapted to deliver a preflattened fabric tube to the spreader, with or without tension, and which includes an angularly adjustable roll for correcting fabric skew.

Another object of this invention is to provide a fabric conditioner of the character stated in which the spreader is novel per se and is constructed to be operatively supported solely by a pair of input feed or control rolls and by opposed pairs of tapered drive rolls driven by a variable speed drive and spaced downstream from the input rolls.

Another object of this invention is to provide a fabric conditioner of the character stated in which the input or control rolls for support of the front or entrance end of the spreader separately engage the upper and lower layers of the fabric tube and are separately and adjustably driven whereby to be able to separately or bodily control the linear advance of both of the upper and lower layers of the fabric tube.

A further object of this invention is to provide a fabric conditioner of the character stated in which the rolls at the calender station are adjustable between a full nip pressure and no nip pressure positions and are driven by a variable speed drive.

A further object of this invention is to provide a fabric conditioner of the character stated in which the variable speed drive for the tapered rolls associated with the spreader establishes the general speed of advance of the fabric tube and in which the speed of the input or control rolls for the spreader and the speed of the calender rolls are separately adjusted relative to that of the tapered rolls whereby to effect selective control over the advance and relative alignment of the upper and lower layers of the fabric as the fabric tube is being bodily advanced.

A further object of this invention is to provide a fabric conditioner of the character stated in which the spreader is pivotally supported between the pairs of tapered drive rolls and in which the associated input or control rolls are mounted in vertically adjustable bearings whereby to effect proper alignment of the delivery end of the spreader with the nip of the calender rolls.

A further object of this invention is to provide a fabric conditioner of the character stated that is simple in design, rugged in construction and economical to manufacture.

With these and other objects, the nature of which will become apparent, the invention, as illustrated, will be more fully understood by reference to the drawings, the accompanying detailed description and the appended claims.

Figure 1:
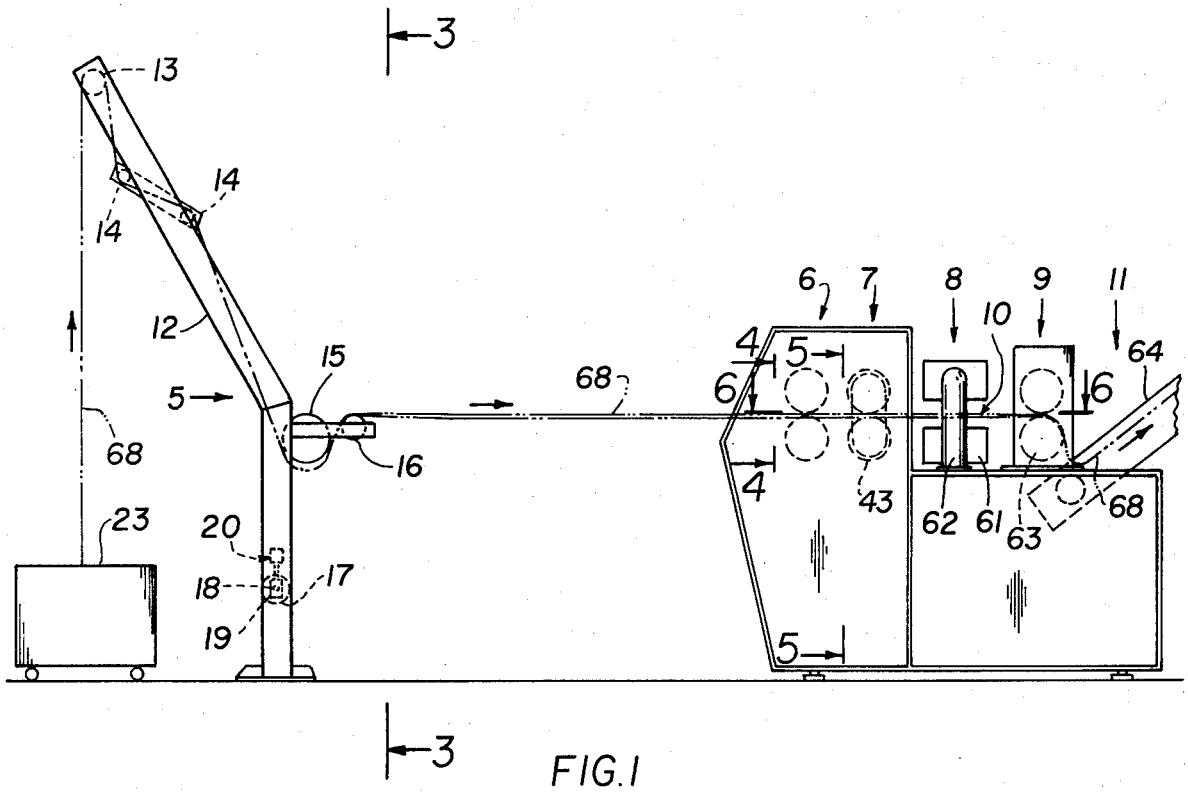
FIG. 1 is a somewhat schematic side elevation of a fabric conditioner constructed in accordance with this invention.
Figure 2:
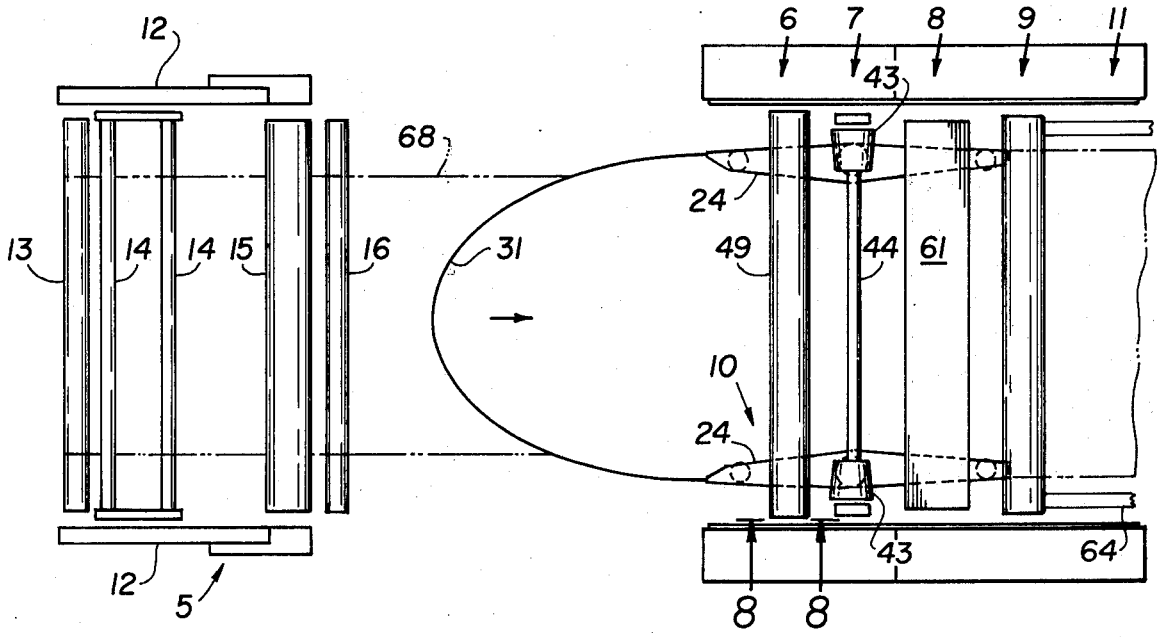
FIG. 2 is a top plan view thereof.
Figure 3:
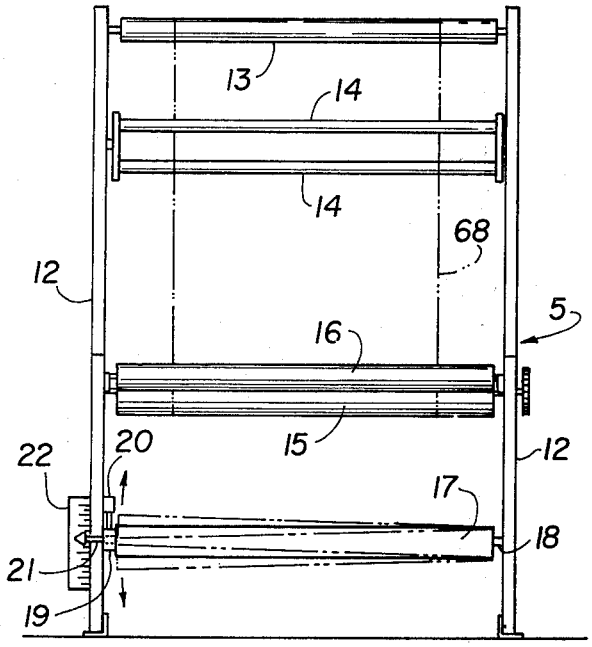
FIG. 3 is a transverse vertical section taken along line 3—3 of FIG. 1.
Figure 10:
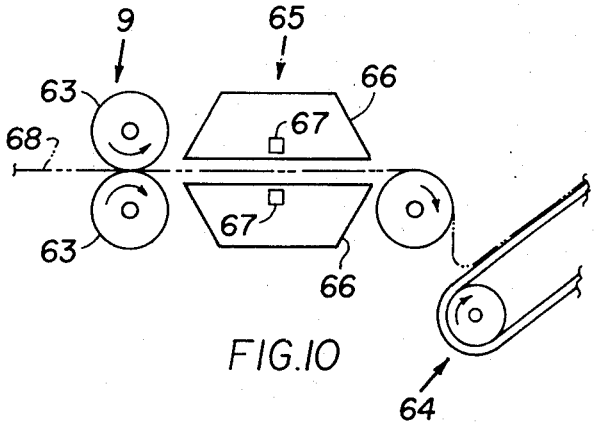
Figure 4:
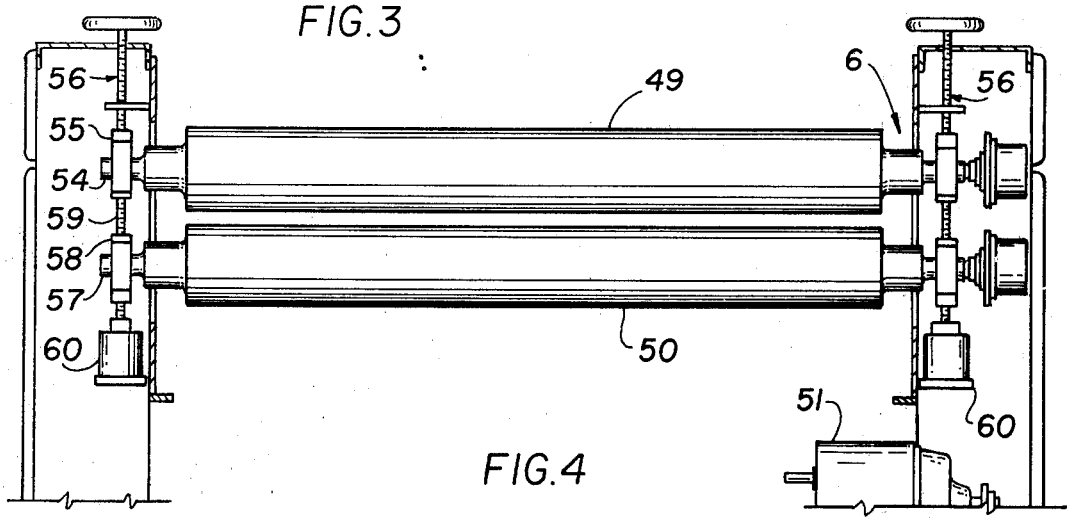
FIG. 4 is a detail transverse vertical section taken along line 4—4 of FIG. 1 and shows the relation between the control rolls and the spreader.
Figure 5:
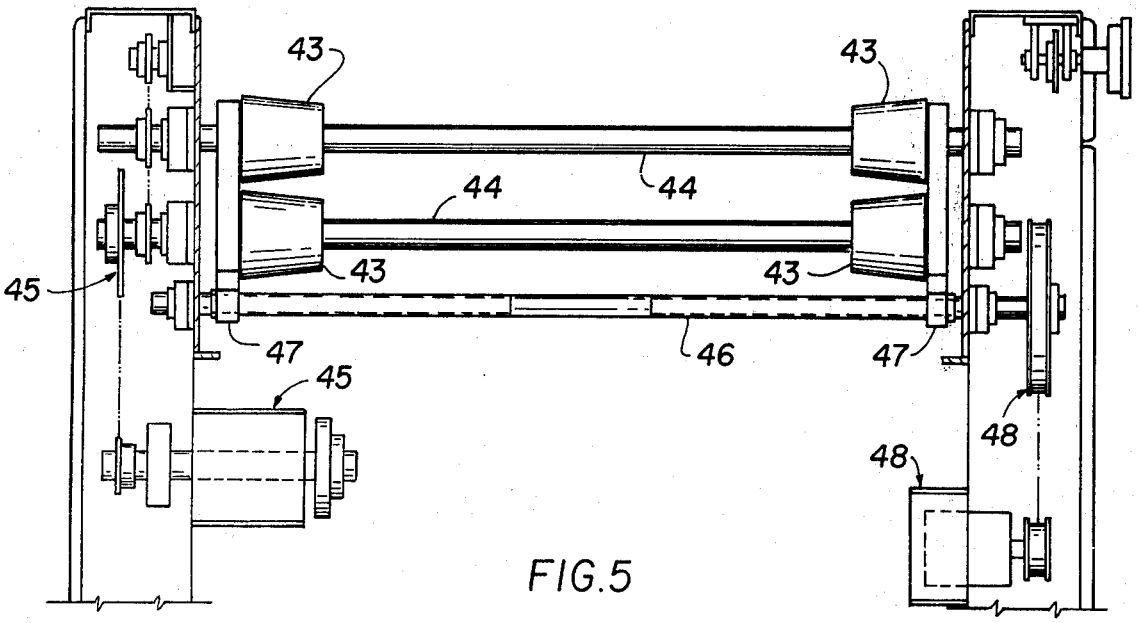
Figure 6:
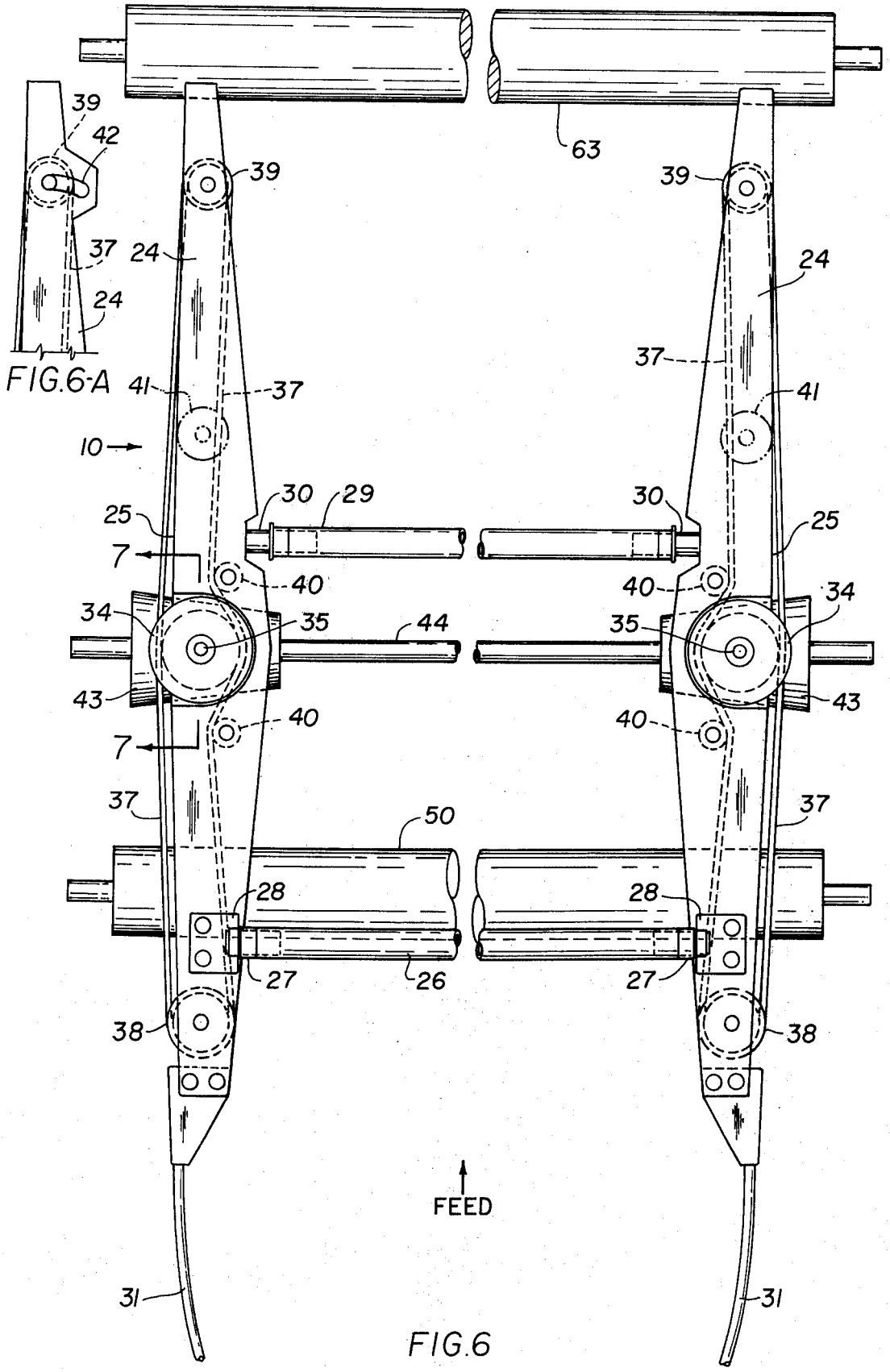
Figure 7:
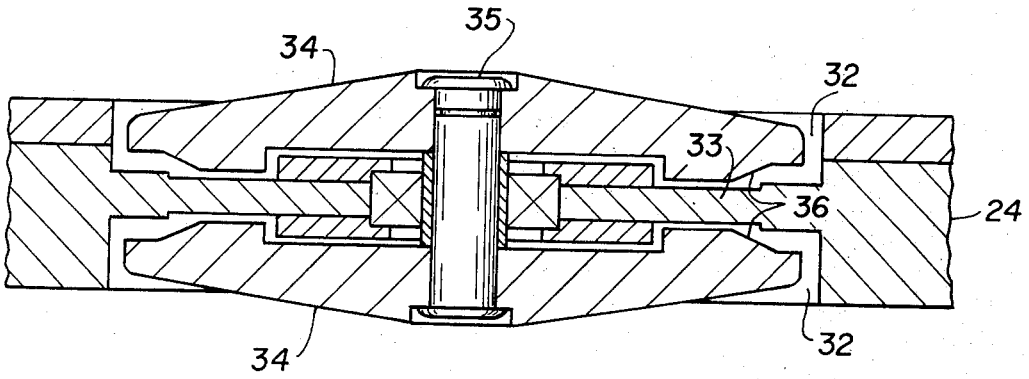
Figure 8:
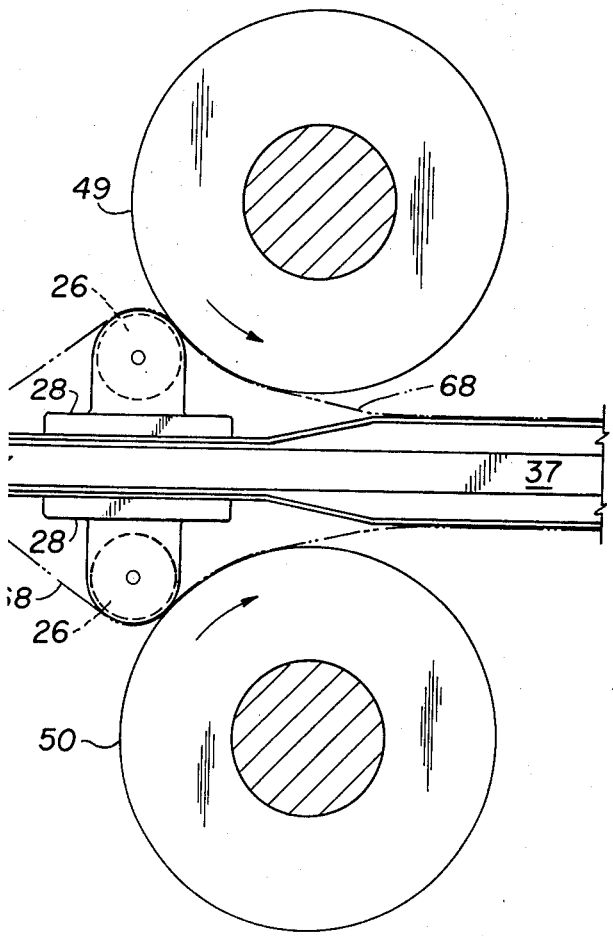
Figure 9:
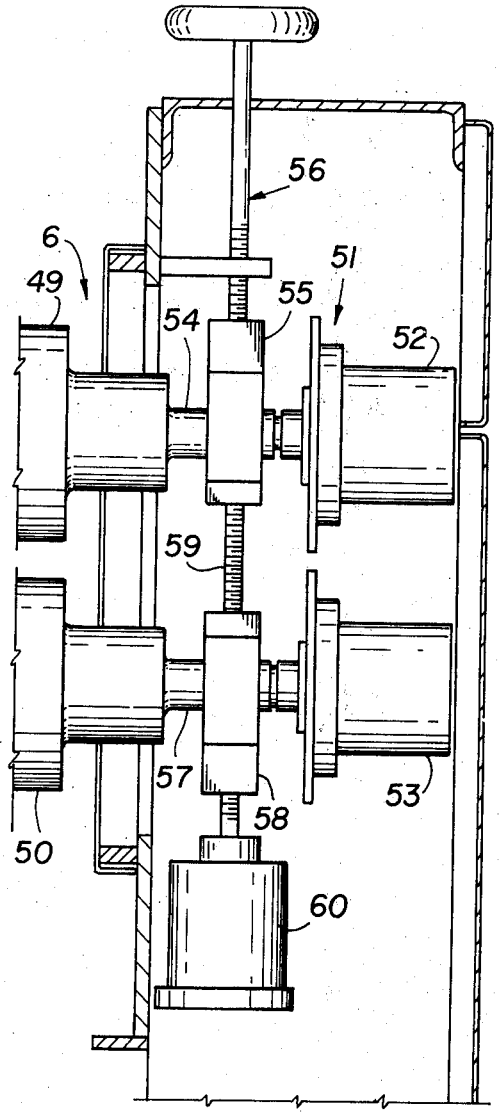

FIG. 5 is a detail transverse vertical section taken along line 5—5 of FIG. 1 and shows the relation between the drive rolls and the spreader; FIG. 6 is a detail horizontal section taken along line 6—6 of FIG. 1 and particularly shows the spreader frame in its installed position; the upper control roll, upper pair of tapered drive rolls, the upper steam hood and the upper calender roll being removed in the interest of clarity;

FIG. 6-A is a detail top plan view of the rear or tip end of a spreader frame member and shows a modification by which the rear end portions of the edge drive V-belts may be adjusted to shorten the effective length of the edge drive as it approaches the rear or tip end of the spreader;

FIG. 7 is a detail longitudinal section taken along line 7—7 of FIG. 6 and shows the mounting of each pair of frustoconical idler wheels on the spreader frame;

FIG. 8 is an enlarged detail end elevation taken along line 8—8 of FIG. 2 and shows the operating relationship between the transverse driven rolls of the spreader and the control rolls;

FIG. 9 is an enlarged detail of the right end portion of FIG. 4 and more clearly shows the adjustable mounts at each end of the control roll shafts for properly positioning and properly spacing the control rolls relative to the spreader frame; and FIG. 10 is a schematic side elevation of a modification of the delivery end of the fabric conditioner by which the conditioned fabric immediately may be thermo-fixed in its conditioned state.

Referring to the drawings in detail the invention, as illustrated, is embodied in a fabric conditioner that comprises a feed stand generally indicated 5 and a fabric conditioning assembly including a control roll station generally indicated 6, a main drive roll station generally indicated 7, a steaming station generally indicated 8, a calender station generally indicated 9, a spreader generally indicated 10 and a delivery station generally indicated 11.

The feed stand 5 is provided with the usual frame members 12, 12 and includes an upper idler roll 13, a pair of spaced parallel offset tension rods 14, 14, an intermediately located driven feed roll 15 having an idler roll 16 associated therewith and disposed in spaced parallel relation with respect thereto, and a lower idler skew-correcting roll 17.

The feed roll 15, preferably is covered with rubber or other suitable material to provide a friction surface and is driven by any suitable type of variable speed drive (not shown).

The skew-correcting roll 17 preferably has a smooth surface and is mounted upon a shaft 18 having one end rotatably mounted in a spherical bearing carried by one of the frame members 12 and its other end mounted in a spherical bearing carried by a block 19 slidably mounted on the other frame member 12 for vertical adjustment by a reversible motor driven screw generally indicated 20. An indicator 21 is carried by the block 19 for cooperation with an index plate 22 to provide visual observation of the position of the block and thus the axis angle of the roll 17, which angle may be changed as required to correct any lateral skew that may appear in the fabric tube as it advances by relatively increasing or decreasing the length of the progressive edge-to-edge travel of the tube as it passes thereunder in contact therewith.

The flattened fabric tube is supplied to the feed stand 5 from the usual truck 23 and fed from the feed stand to the spreader 10 for the further conditioning operations.

The spreader 10 is operably supported by the rolls at the control roll station 6 and by the tapered rolls at the drive roll station 7 and has a length extending from a position ahead of the control roll station to a rear terminus at the calender station 9 and a width that is adjustable in conformity to the desired spread width of the fabric tube upon which the conditioning operations are being performed.

As shown particularly in FIGS. 6, 7 and 8, the spreader 10 includes a pair of spaced generally parallel horizontal frame members 24, 24 having parallel outer edges 25, 25.

The front ends of the frame members 24 are maintained in any predetermined spaced relation by a pair of upper and lower tubular rolls 26, 26 that are each freely mounted on a pair opposed bearing-mounted rotatable spindles 27, 27 carried by brackets 28, 28 affixed to the upper and lower faces of the frame members. All that it is necessary to do to change the spacing between the front ends of the frame members 24 is to replace the rolls 26 by correspondingly longer or shorter rolls.

Similarly, the rear ends of the frame members 24 are maintained in the same predetermined spacing either by a single spacer tube 29 freely fitted on a pair of opposed studs 30, 30 affixed to the frame elements, or by an equivalent telescopically adjustable spacer tube.

A generally horizontal U-shaped heavy gauge wire guide or bow 31 has its ends removably secured to the front ends of the frame members 24 and is sufficiently flexible to adapt to changes in spacing therebetween. Of course, if the range of frame member spacing is too great, the single bow 31 may be replaced by two separate oppositely curved bow elements, each of which is carried by one of the frame members, thus avoiding the necessity for flexing the bow to a different span but without adversely affecting the guiding and preliminary lateral stretching of the fabric tube.

The spreader also is constructed to provide a circumferential drive or feed of the fabric tube adjacent the entrance of the spreader, a tube face drive or feed in its intermediate portion and an inner edge drive along all or a substantial portion of its length.

For these purposes the tube face drive first will be described because its speed of advance is used as the norm against which all other operative speed adjustments are made, as will be hereinafter more fully described, and because the inner edge drive is driven therefrom.

Accordingly, the upper and lower faces of each frame member 24 are provided with a pair of outwardly opening recesses 32, 32 above and below a median web 33 which rotatably supports a pair of generally frustoconical idler wheels 34, 34 mounted on a common vertical shaft or spindle 35 and having portions of their peripheries extending beyond the outer edges of the frame members. The opposed inner peripheral face portions of the idler wheels 34 diverge as at 36 to define a pulley groove of a generally V-shaped cross-section for operative engagement with an edge drive V-belt.

Each frame member 24 is provided with an edge drive V-belt 37 mounted between the upper and lower faces thereof and including a forward loop passing around a forward idler pulley 38 having a portion of its periphery extending beyond the outer edge of its associated frame member, a rear or tip loop passing around a rear idler pulley 39 having a portion of its periphery coplanar with the outer edge of its associated frame member so that the belt merges therewith at that location, and two intermediate flight portions that engage in opposite sides of the V-groove of the idler wheels 34 for driven association therewith. Supplementary idler rolls 40, 40 are located to provide a partial driven wrap of the V-belt around an inner portion of the wheels 34 and either of the idlers 40 may be adjustably mounted to provide tension adjustment or slack take-up to the V-belt.

The V-belts, as described above, provide the spreader with substantially full length edge drive or feed of the fabric tube for control operations such as the straightening conditioning of transversely striped or patterned fabric tubes. However, for other types of control operations, such as the so-called overfeed conditioning of plain fabric tubes, the V-belts should be effectively shortened to provide a non-edge-drive zone at the delivery end of the spreader to permit an overfeed accumulation of the fabric tube thereon.

One way of achieving this latter objective is to relocate the rear idler pulleys 39 to the positions indicated by dotted lines at 41, and use correspondingly shorter V-belts.

However, as shown in the modification of FIG. 6-A, it may be preferable to adjustably position the shafts or spindles of the idler pulleys 39 in transverse slots 42 so that those pulleys can be moved toward each other a distance sufficient to cause the V-belts to merge into the frame members at the positions of the idler pulleys installed at the locations 41.

In either type of construction the spreader is adaptable for use with either full length or less than full length edge drive or feed of the fabric tube, as may be required by the particular type of fabric tube conditioning involved.

The face drive of the fabric tube is effected by opposed pairs of rubber covered feed rolls 43, 43 mounted on a pair of spaced parallel oppositely rotating splined drive shafts 44, 44 operably connected to any suitable variable speed drive unit generally indicated 45. Each pair of feed rolls 43 is tapered to conform to the conical faces of the frusto-conical wheels 34 for driving same and their associated edge drive V-belts 37 and for advancing face portions of the interposed fabric layers. Lateral spacing between the pairs of rolls 43 may be changed through the use of an oppositely threaded cross-screw 46 threadably engaged with roll bearing blocks 47, 47 slidably mounted on the shafts 44. The cross-screw 46 may be driven in either direction of rotation by any suitable reversible motor drive generally indicated 48, thus enabling the spacing between the pairs of rolls 43 to be changed to conform to any change of spacing between the frame members 24 of the spreader.

The spreader 10 thus has its mid portion drivingly but freely supported by the tapered rolls 43 and can pivot about a transverse horizontal axis lying in a plane therebetween.

The circumferential feed of the fabric tube is effected at the front portion of the spreader by a combination of the V-belts 37, the spindles 27 and the tubular spacer rolls 26 through the medium of independently controlled and driven rolls at the control roll station 6, as now will be described.

The control roll station 6 (see FIGS. 1, 2, 4 and 9) includes an upper control roll 49 and a lower control roll 50 adapted to be respectively driven in opposite directions from a suitable type of variable speed drive unit generally indicated 51 through an upper adjustably air-loaded friction clutch 52 and a lower adjustably air-loaded friction clutch 53.

The upper control roll 49 is mounted on a shaft 54 journalled in slide-mounted bearing blocks 55, 55 for vertical adjustment by associated handwheels and adjusting screws generally indicated 56, 56. The lower control roll 50 similarly is mounted on a shaft 57 journalled in slide-mounted bearing blocks 58, 58 for vertical adjustment relative to the bearing blocks 55 so that, once the upper control roll 49 has become properly positioned, the lower control roll 50 may be properly positioned with respect thereto. For this latter purpose each of the lower bearing blocks is provided with an upstanding spacing screw 59 threadably engaged therein and having its upper end disposed in abutting relation with the lower face of its associated upper bearing block 55 to establish and maintain proper clearance between the upper and lower control rolls 49 and 50. Air cylinders 60, 60 disposed beneath the lower bearing blocks 58 are employed to lift and releasably maintain the lower control roll 50 in its adjustably set position relative to that of the upper control roll 49 once the position of that roll has been set by the handwheels 56 and the clearance between the two control rolls has been set by adjustment of the abutment or spacing screws 59.

Normally, the spacing between the upper and lower control rolls 49 and 50 is such that the front portion of the spreader 10 will fit with clearance therebetween, as indicated in FIG. 8, and the front face portions of the control rolls will form transverse fabric feeding nips with the associated spindles 27 and the tubular spacer rolls 26 of the spreader. Thus, the control rolls themselves additionally serve as rolling abutments to restrain the spreader against linear advance in the direction of fabric feed. When the spreader 10 is initally inserted into its operative position in the assembly, air is released from the cylinders 60 to lower the lower control roll 50 and provide temporarily greater spacing between the control rolls, after which the lower control roll is returned to its preset operative position by the air cylinders.

As previously mentioned, the spreader 10 has a length sufficient to extend beyond the drive roll station 7 past the steaming station 8 and terminate with its rear tip in proximity to the nip between the rolls of the calender station 9.

The steaming station 8 (see FIGS. 1 and 2) simply comprises a pair of oppositely disposed transverse hoods 61, 61 above and below the spreader 10 and adapted to be supplied with moist steam as through valve-controlled pipes generally indicated 62.

The calender station 9 (see FIGS. 1, 2) includes the usual pair of upper and lower horizontally disposed calender rolls 63, 63 adapted to be driven in opposite directions by a suitable variable speed take-off (not shown) from the main variable speed drive 45 for the tapered feed rolls 43. One or the other of the calender rolls is mounted for adjustment relative to the other thereof whereby to provide the usual adjustments to nip pressure and clearance.

From the calendar station 9, the conditioned fabric tube may be delivered to a take-away conveyor generally indicated 64 (see FIG. 1) for transfer to an associated folder, batcher or other receiving device.

However, because many of the fabric tubes to be conditioned by this equipment may be formed from all synthetic fibers such as polysters or from blends containing a substantial portion of synthetic or polyester fibers, both types of which may require thermo-fixing to maintain the effected conditioning, the equipment may also include a thermo-fixing station, generally indicated 65, located between the calender station and the takeaway conveyor as schematically illustrated in FIG. 10 of the drawings.

The thermo-fixing station 65 comprises a pair of oppositely disposed radiant heaters 66, 66, separately controlled by pyrometers 67, 67 to independently adjust the output from the heaters 66 to establish and maintain the desired heat-setting or thermo-fixing temperatures of both layers of the conditioned fabric tube. The temperatures required for this purpose are on the order of 300°–350° F whenever any synthetic or polyester fibers are present in the fabric tube, but would be somewhat lower if the tube is knitted from all-cotton or other natural fibers or yarns.

As previously mentioned, this equipment can be used as both a straightening calender for finishing transversely striped or patterned circular knit fabric tubes and as an overfeed calender for finishing plain circular knit fabric tubes.

When the equipment is operated as a straightening calender, a flattened fabric tube 68 is led from a supply truck 23 over the upper idler roll 13 of the feed stand 5, then under the skew roll 17 and over the idler roll 16 from which it is stretched over the guide bow 31 of the spreader 10. The tube 68 then is advanced over the spreader so that its upper layer passes over the upper tubular roll 26, but beneath the upper control roll 49, and its lower layer passes beneath the lower tubular roll 26 and over the lower control roll 50. The tube 68 then is further advanced so that its upper and lower layers are brought into face feeding contact between the tapered feed rolls 43 and their associated frusto-conical wheels 34, after which the tube is further advanced over the spreader past the steaming station and through the nip of the calender rolls 63, from which it is delivered to the take-away conveyor 64 either directly or via the thermo-fixing station 65 if thermo-fixing is to be effected.

In this type of operation, the edge drive V-belts 37 of the spreader are full length as shown in FIG. 6 so that the fabric tube is controlably fed along the full length of the spreader frame and no overfeed or accumulation of the tube can occur at any place therealong.

In this type of operation, the mean or nominal speed of advance of the fabric tube is established by driving the tapered feed rolls 43 at a predetermined speed and the straightening calendering is effected by relatively varying the effective speeds of the upper and lower control rolls 49 and 50 and the calender rolls 63, with or without skew correction by varying the axis angle of the skew roll 17.

Thus, after the nominal speed of advance has been established for a transversely striped or patterned fabric tube and visual observation indicates that only skew correction need be made to bring the striping or pattern into proper transverse orientation, that correction can be made simply by operating the motor driven screw 20 of the skew roll 17 to change its axis angle in the proper direction up or down to the degree necessary to make the skew correction and after the skew correction has been completed, the skew roll 17 is returned to its normal horizontal position. However, if visual observation should indicate that bowing of the striping or pattern is occurred in either fabric layer or that one fabric layer is becoming misaligned with respect to the other thereof, the necessary straightening corrections can be made first by driving the upper and lower control rolls 49 and 50 at a speed slightly less than that of the calender rolls 63 to create a fabric tension between tubular circumferential drive rolls 26 and the calender rolls, and then individually adjusting the friction clutches 52 and 53 of the control rolls to relieve the tension as desired to straighten the striping or pattern of either fabric layer and/or to properly align the two layers. Once the upper and lower fabric layers are straightened and in proper alignment the speed of the calender rolls can be increased or decreased to increase or decrease the fabric tension between the control rolls and the calender rolls so that the center portions of both layers of fabric thus will be either advanced or retarded to fully straighten the striping or pattern. The foregoing adjustments in the relative advance or retardation of the fabric layers can be made in the manner described because the edges of the fabric tube are driven at a substantially constant speed by the spreader V-belts 37 via the tapered feed rolls 43 and changes in the advance or retardation of the fabric layers are made relative thereto. Also, any change in the fabric tension between the control roll station 6 and the calender station 9 is not disrupted by the interposition of the tapered feed rolls 43 because they drive the fabric by nip contact with the frustoconical wheels 34 and relative slippage of the fabric layers can occur when any such change in fabric tension is made.

When the equipment is operated as an overfeed calender to condition plain fabric tubes knitted from natural fibers, the flattened fabric tube 68 is led from the supply truck 23 over the upper idler roll 13 of the feed stand 5 as before, but instead of passing under the skew roll 17 it is passed under the driven feed roll 15 and then over the idler roll 16 and onto the spreader. In this type of operation the fabric is delivered to the spreader substantially without tension since the speed of the feed roll 15 is adjusted to deliver the fabric tube to the spreader slightly faster than it is being taken away by operation of the spreader, thus causing the fabric to periodically loop down away from feed roll which thus periodically stops feeding even through it is continuously rotating at a constant speed. Each time such a loop is formed the back tension from the fabric in the truck causes the fabric to engage the feed roll again. This repetitive grip and slip action maintain a generally slack condition between the feed roll and the spreader.

In order to establish the desired overfeed, as the result of which the fabric becomes bunched on the spreader at the steaming station, the edge drive V-belts 37 of the spreader are effectively shortened, as previously described, either by shorter V-belts haing their delivery loops engaged around the short location idlers 41 or by moving their delivery ends substantially toward each other by the end mounting shown in FIG. 6A; both friction clutches for the control rolls 49 and 50 are fully engaged; and the variable speed drive are adjusted to overfeed the fabric relative to the feed at the calender station 9. In this manner the plain knit fabric tube becomes properly steam heated and moistened prior to its entry into the nip of the calender rolls which then serve to produce the desired ironed finish on the natural fiber fabric.

In both the straightening and overfeed types of conditioning operations, the spreader 10 is freely mounted between the sets of tapered feed rolls 43 with its rear tip aligned with and in proximity to the nip of the calender rolls and its forward portion located between the upper and lower control rolls 49 and 50 so that the tubular rolls 26 abut thereagainst both to establish the circumferential feed of the fabric tube and to serve as abutments which restrain the spreader against movement in the direction of fabric advance. Also, the opposed lateral forces imposed by the tapered feed rolls 43 plus those applied by the laterally stretched fabric tube against the edge drive V-belts 37, keep the spreader frames in their properly spaced setting as determined by the lengths of the rolls 26 and the spacer tube 29. Accordingly, any desired change in the operational width of the spreader is effected simply by bodily pulling the spreader frame forwardly until it is clear of the control roll station 6, then replacing the rolls 26 and tube 29 with others of the proper lengths, and then reinserting the reassembled spreader frame back into the unit and making a corresponding adjustment to the spacing between the sets of tapered feed rolls 43 by operation of the cross-screw 46. Proper alignment of the rear tip of the spreader frame with the nip of the calender rolls 63 is readily effected by suitable adjustment of the vertical positions of the control rolls 49 and 50 to cause the spreader frame to pivot about its transverse horizontal axis at the location of the tapered feed rolls 43 which serve as pivots.

It is of course to be understood that variations in arrangements and proportions of parts may be made within the scope of the appended claims.

I claim:

1. Apparatus for conditioning and calendering circular knit fabric tubes including; a control roll station provided with a pair of transverse spaced parallel horizontal upper and lower control rolls engageable across the upper and lower faces of a flattened fabric tube advancing therebetween; a drive roll station located downstream from said control roll station and provided with two laterally spaced pairs of opposed drive rolls engageable with portions of the upper and lower faces of said flattened fabric tube; and steaming station located downstream from said drive roll station and provided with a pair of opposed transverse hoods for applying steam to said fabric tube; a calender station located downstream from said steaming station and provided with a pair of opposed transverse calender rolls; a horizontal spreader for spreading said flattened fabric tube to a predetermined width during its advance through said apparatus, said spreader being interposed between said control rolls, said drive rolls and said steam hoods and being provided with a frame extending from said control roll station into proximity to said calender station, said spreader being provided at its forward end with a pair of freely rotatable oppositely disposed transverse circumferential drive rolls located in nip-defining relation to front portions of said control rolls whereby to provide a circumferential feed control for the upper and lower layers of said spread fabric tube and to support the front end of said spreader frame intermediate said control rolls, the engagement of said circumferential drive rolls against said control rolls being effective to restrain said spreader against movement in the direction of advance of said fabric tube, the mid portion of said spreader frame being supported by engagement between said pairs of drive rolls and the rear portion of said spreader frame being extended cantileverly into proximity to said calender station; means for driving said control rolls in opposite directions and operable to effect selective control over the advance and relative alignment of the upper and lower layers of the fabric tube; means for driving said pairs of drive rolls in opposite directions; means for supplying steam to said steam hoods; and means for driving said calender rolls in opposite directions.

2. The apparatus of claim 1 in which said spreader additionally includes means operated from said drive rolls for internally engaging and advancing the edges of said spread fabric tube.

3. The apparatus of claim 2 additionally including means for vertically adjusting the position of one of said control rolls relative to the general plane of said spreader; and separate means for adjusting the spacing between said one control roll and the other thereof.

4. The apparatus of claim 1 additionally including a feed stand located ahead of said control roll station for supplying an unspread flattened fabric tube to said spreader, said feed stand being provided with a transverse constantly driven feed roll and an idler roll disposed in spaced parallel relation with respect to said feed roll, said fabric tube being passed beneath said feed roll and over said idler roll before its engagement over said spreader, said feed roll being driven at a peripheral speed slightly greater than the speed of advance of said fabric tube through the several stations of said apparatus whereby to permit said fabric tube to enter into engagement with said spreader with a minimum of tension between said feed roll and said spreader.

5. The apparatus of claim 1 additionally including a thermo-fixing station located downstream of said calender station and comprising a pair of opposed radiant heaters disposed above and below the faces of said fabric tube for applying thermo-fixing heat thereto.

6. The apparatus of claim 1 in which said means for driving said control rolls is a variable speed drive and additionally includes means for selectively controlling the effective operational speed of each of said control rolls.

7. The apparatus of claim 1 in which said means for driving said control rolls is a variable speed drive and additionally includes means for selectively controlling the effective operational speed of each of said control rolls; in which said means for driving said pairs of said drive rolls is a variable speed drive; and in which said means for driving said calender rolls is a variable speed drive; the variable speed drive for said pairs of said drive rolls being adjustable to establish a predetermined standard speed of advance of said fabric tube and the variable speed drives for said control rolls and said calender rolls being adjustable relative to said established standard speed.

8. The apparatus of claim 7 in which said spreader additionally includes means operated from said drive rolls for internally engaging and advancing the edges of said spread fabric tube.

9. The apparatus of claim 8 in which said tube edge advancing means extends substantially the full length of said spreader frame.

10. The apparatus of claim 8 in which said tube edge advancing means extends along said spreader frame from the location of said control roll station through the location of said drive roll station.

* * * * *